US006774187B2

(12) United States Patent
Voorheis et al.

(10) Patent No.: US 6,774,187 B2
(45) Date of Patent: Aug. 10, 2004

(54) GOLF BALL CORES COMPRISING BLENDS OF POLYBUTADIENE RUBBERS

(75) Inventors: Peter R. Voorheis, Fall River, MA (US); Samuel A. Pasqua, Jr., Tiverton, RI (US); Michael J. Sullivan, Barrington, RI (US); David A. Bulpett, Boston, MA (US); Derek A. Ladd, Fairhaven, MA (US)

(73) Assignee: Acushnet Company, Fairhaven, MA (US)

( * ) Notice: Subject to any disclaimer, the term of this patent is extended or adjusted under 35 U.S.C. 154(b) by 35 days.

(21) Appl. No.: 10/164,809

(22) Filed: Jun. 7, 2002

(65) Prior Publication Data

US 2003/0229183 A1 Dec. 11, 2003

(51) Int. Cl.[7] ..... A63B 37/06; A63B 37/12

(52) U.S. Cl. ..... 525/193; 525/274; 473/354; 473/373; 473/374; 473/375; 473/376

(58) Field of Search ..... 525/193, 274; 473/354, 373, 374, 375, 376

(56) References Cited

U.S. PATENT DOCUMENTS

| | | | | | |
|---|---|---|---|---|---|
| 4,683,257 | A | | 7/1987 | Kakiuchi et al. | 524/432 |
| 4,929,678 | A | | 5/1990 | Hamada et al. | 525/193 |
| 4,931,376 | A | | 6/1990 | Ikematsu et al. | 430/164 |
| 4,955,613 | A | | 9/1990 | Gendreau et al. | 473/372 |
| 4,974,852 | A | | 12/1990 | Hiraoka et al. | 473/372 |
| 4,984,803 | A | | 1/1991 | Llort et al. | 473/377 |
| 5,082,285 | A | | 1/1992 | Hamada | 473/372 |
| 5,482,285 | A | * | 1/1996 | Yabuki et al. | 473/373 |
| 5,490,674 | A | * | 2/1996 | Hamada et al. | 473/373 |
| 5,743,816 | A | * | 4/1998 | Ohsumi et al. | 473/376 |
| 5,830,086 | A | * | 11/1998 | Hayashi et al. | 473/376 |
| 6,135,899 | A | * | 10/2000 | Maruko | 473/376 |
| 6,139,447 | A | | 10/2000 | Ohama | 473/378 |
| 6,194,505 | B1 | | 2/2001 | Sone et al. | 524/432 |
| 6,258,302 | B1 | | 7/2001 | Nesbitt | 264/40.1 |
| 6,277,920 | B1 | | 8/2001 | Nesbitt | 525/274 |
| 6,287,216 | B1 | | 9/2001 | Boehm | 473/354 |
| 6,315,682 | B1 | * | 11/2001 | Iwami et al. | 473/374 |
| 6,315,684 | B1 | | 11/2001 | Binette et al. | 473/377 |
| 6,325,730 | B1 | | 12/2001 | Binette et al. | 473/377 |
| 6,376,612 | B1 | | 4/2002 | Nesbitt et al. | 525/236 |
| 6,394,915 | B1 | | 5/2002 | Nesbitt | 473/378 |
| 6,521,711 | B1 | * | 2/2003 | Ohama et al. | 525/274 |

FOREIGN PATENT DOCUMENTS

| | | |
|---|---|---|
| WO | WO 00/40303 | 7/2000 |
| WO | WO 00/40304 | 7/2000 |
| WO | WO 01/10510 | 2/2001 |
| WO | WO 01/10511 | 2/2001 |

OTHER PUBLICATIONS

U.S. patent application Ser. No. 09/904,617, Tzivanis et al., filed Jul. 2001.
U.S. patent application Ser. No. 09/894,960, Nesbitt, filed Jun. 2001.
U.S. patent application Ser. No. 09/826,727, Nesbitt, filed Apr. 2001.

* cited by examiner

*Primary Examiner*—David J. Buttner

(57) ABSTRACT

A golf ball comprising a solid core and a cover disposed about the core, wherein the core is formed from a polybutadiene blend comprising a) a first polybutadiene having a first Mooney viscosity between about 50 and about 150, and b) a second polybutadiene having a second Mooney viscosity between about 30 and about 100, wherein the first Mooney viscosity is greater than the second Mooney viscosity, and wherein the blend has a greater weight percentage of the first polybutadiene than that of the second polybutadiene.

13 Claims, No Drawings

GOLF BALL CORES COMPRISING BLENDS OF POLYBUTADIENE RUBBERS

FIELD OF THE INVENTION

The present invention relates to golf balls, more particularly to golf ball core compositions comprising blends of polybutadiene rubbers having improved properties and processability.

BACKGROUND OF THE INVENTION

Conventional golf balls can be divided into two general classes: solid and wound. Solid golf balls include one-piece, two-piece (i.e., solid core and a cover), and multi-layer (i.e., solid core of one or more layers and/or a cover of one or more layers) golf balls. Wound golf balls typically include a solid, hollow, gas-filled, gel-filled or fluid-filled center, surrounded by a tensioned elastomeric material, and a cover. Solid balls have traditionally been considered more durable than wound balls, but many solid constructions lack the preferred "feel" provided by the wound construction.

By altering ball construction and composition, manufacturers can vary a wide range of playing characteristics, such as compression, velocity, feel, and spin, each of which can be optimized for various playing abilities. In particular, a variety of core and cover layer(s) constructions, such as multi-layer balls having double cover layers and/or dual core layers, have been investigated. These golf ball layers are typically constructed with a number of polymeric compositions and blends, including, but not limited to, polybutadiene rubber, polyurethanes, polyamides, and ethylene-based ionomers.

The core of solid golf balls is the "engine" of the ball, providing the velocity required for good distance. Too hard a core, however, can result in a golf ball that provides poor feel. Manufacturers are constantly experimenting with various core compositions and constructions in an effort to optimize both feel and distance. Most conventional solid cores comprise polybutadiene rubber ("BR") or some modified form thereof, which provides the primary source of resiliency for the golf ball.

BR core compositions still have room for improvement in resilience, which is determined by coefficient of restitution ("COR"). Familiar to those skilled in the golf ball art, the COR along with angle of trajectory (i.e., launch angle) and clubhead speed determine the distance a golf ball will travel when hit by a golf club. One way to measure the COR is to propel a ball at a given speed against a hard massive surface and measure its incoming and outgoing velocity. The COR is the ratio of the outgoing velocity to the incoming velocity and is expressed as a decimal between zero and one. There is no United States Golf Association limit on the COR of a golf ball, but the initial velocity of the golf ball cannot exceed 250±5 feet/second. As a result, the industry goal for initial velocity is 255 feet/second, and the industry strives to maximize the COR without violating this limit.

In general, BR's of high molecular weight (high Mooney viscosity) have better resilience than BR's of low molecular weight (low Mooney viscosity). However, as the molecular weight increases, the milling and processing properties of the BR deteriorate. BR catalyzed with lanthanide series elements such as neodymium tends to be linear and narrow in polydispersity (close to 1.0). The narrow polydispersity allows high-molecular weight Nd—BR of to process readily, but the linearity causes problems in extrusion processes such as die swell and cold flow. BR catalyzed with cobalt and/or nickel, in comparison to Nd—BR, tends to be more branched and have wider polydispersity (distant from 1.0). While the branching characteristic facilitates processing, the wide polydispersity generally gives low resilience. Advantageously, blends of Co/Ni—BR and Nd—BR in core compositions enhance resilience in the resulting golf balls.

Attempts to improve golf ball COR by using various blends of BR in core compositions include, among others, U.S. Pat. Nos. 4,683,257; 4,931,376; 4,955,613; 4,984,803; 5,082,285; 6,139,447; 6,277,920; and 6,315,684. Although some of the core compositions described in these disclosures are satisfactory, a need remains for compositions with improved properties and processabilility to form golf balls.

SUMMARY OF THE INVENTION

The present invention is directed to a golf ball having a solid core and a cover. The solid core is formed from a blend of two polybutadiene rubbers, one made with a cobalt or nickel catalyst and having a higher Mooney viscosity between about 50 and about 150, another made with a lanthanide series catalyst and having a lower Mooney viscosity between about 30 and about 100. A neodymium catalyst is a preferred lanthanide series catalyst. The blend has more of the Co/Ni—BR and less of the Nd—BR, with a ratio of weight percentage between the two being preferably at least about 51:49, more preferably at least about 60:40, and most preferably at least about 75:25.

Preferably, the Co/Ni—BR has a Mooney viscosity between about 60 and about 150, a number average molecular weight between about 150,000 and about 250,000, and a polydispersity between about 1.50 and about 3.50, while the Nd—BR has a Mooney viscosity between about 35 and about 90, a number average molecular weight between about 150,000 and about 275,000, and a polydispersity between about 1.25 and about 2.75. More preferably, the Mooney viscosity of the Co/Ni—BR is between about 70 and about 130, and the Mooney viscosity of the Nd—BR is between about 45 and about 80. The polybutadiene blend also has a cis-1,4 bond content of at least about 80% in the polymer chains, and it comprises preferably at least about 65% by weight of the golf ball core, more preferably between about 70% and about 85%.

One conventional adduct to the BR blend is a reactive co-agent that crosslinks (i.e., vulcanizes) the BR. To prevent water absorption to the core and enhance the durability of the golf ball, the amount of co-agent is minimized to preferably less than about 10 parts per hundred ("phr") by weight of the BR blend, more preferably less than about 5 phr, and most preferably about 0 phr (no co-agent). Alternatively, a moderately hard core may be achieved using the co-agent in an amount between about 10 phr and about 50 phr by weight of the BR blend. Furthermore, the core may be very hard and dense when at least about 50 phr of the co-agent is incorporated into the core. The co-agent is preferably a salt of an unsaturated carboxylic acid having about 3 to 8 carbon atoms; an unsaturated vinyl compound; a polyfunctional monomer; phenylene bismaleimide; or a mixture thereof.

Besides the Co/Ni—BR and Nd—BR blend, the solid golf ball core may further comprise other species of BR, as well as natural rubber; balata; gutta-percha; synthetic polyisoprene; styrene-butadiene rubber; styrene-propylene-diene rubber; chloroprene rubber; acrylonitrile rubber; acrylonitrile-butadiene rubber; ethylene-propylene rubber; ethylene-propylene-diene terpolymer; and mixtures thereof. Preferably, the core has an outer diameter of about 1.40 inches to about 1.65 inches, and the cover has a thickness of about 0.01 inches to about 0.20 inches. The core may comprise a center and at least one outer core layer, at least one of which comprises the Co—BR and Nd—BR blend. The cover may comprise one or more layers including inner cover layer and outer cover layer.

The present invention is also directed to a multi-layer golf ball comprising a core, a cover, and at least one intermediate layer disposed between the core and the cover. The intermediate layer preferably comprises an elastomeric composition having a reactive co-agent in an amount less than about 10 phr by weight of the elastomer, so that the intermediate layer has moisture vapor barrier properties. Specifically, the intermediate layer has a water vapor transmission rate of less than about 250 g·mil/100 $in^2$·24 h. The co-agent may be a salt of an unsaturated carboxylic acid having about 3 to 8 carbon atoms; an unsaturated vinyl compound; polyfunctional monomer; phenylene bismaleimide; or a mixture thereof. The core may be solid, hollow, gas-filled, gel-filled, or fluid-filled. The core may also comprise a center and at least one outer core layer.

The elastomeric composition of the intermediate layer comprises a BR blend of a Co/Ni—BR with a higher Mooney viscosity of from about 50 to about 150, and a Nd—BR with a lower Mooney viscosity of from about 30 to about 100. The ratio of weight percentage between the two BR's ranges from about 5:95 to about 95:5. Content of the co-agent may be between about 10 phr and about 50 phr by weight of the elastomer for moderate hardness, or at least about 50 phr for a dense intermediate layer.

For such a multi-layer golf ball, the core may have an outer diameter of about 0.25 inches to about 1.60 inches. The intermediate layer comprises one or more layers, preferably having an overall thickness between about 0.01 inches and about 0.60 inches, more preferably between about 0.02 inches and about 0.10 inches. The cover of the multi-layer golf ball may have a single layer, or multiple layers including at least one inner cover layer and an outer cover layer. The core may have a center and at least one outer core layer. Other suitable adducts for the elastomeric composition of the intermediate layer include natural rubber; balata; gutta-percha; cis-polybutadiene; trans-polybutadiene; synthetic polyisoprene; polyoctenamer; styrene-propylene-diene rubber; metallocene rubber; styrene-butadiene rubber; ethylene-propylene rubber; chloroprene rubber; acrylonitrile rubber; acrylonitrile-butadiene rubber; styrene-ethylene block copolymer; ethylene-propylene-diene terpolymer; maleic anhydride or succinate modified metallocene catalyzed ethylene copolymer; polypropylene resin; ionomer resin; polyamide; polyester; urethane; polyurea; chlorinated polyethylene; polysulfide rubber; flurocarbon; or a mixture thereof.

The present invention is further directed to a golf ball comprising a core, a cover, and at least one thin dense intermediate layer disposed between the core and the cover. This thin dense intermediate layer comprises an elastomeric composition having at least about 15 phr of a reactive co-agent, preferably at least about 50 phr, and at least one density-modifying filler to achieve a specific gravity of at least about 1.2. The thin dense intermediate layer has a thickness between about 0.01 inches and about 0.10 inches.

DETAILED DESCRIPTION OF THE INVENTION

Broadly, the present invention is directed to golf balls having a core composition comprising a blend of BR. The ball may be a two-piece, multi-layer, or wound ball having cores comprising a blend of BR of the types disclosed herein, as well as intermediate layers, covers and/or coatings. The ball may also be a one-piece ball having a homogenous core comprising a blend of BR, and a coating around the core. The core compositions of the invention, when utilized in formulating golf ball cores, provide improved workability of the BR, facilitate the process of core formation, and produce cores with enhanced resilience.

A "cover" or a "core" as these terms are used herein includes a structure comprising either a single mass or one with two or more layers. As used herein, a core described as comprising a single mass means a unitary or one-piece core. The layer thus includes the entire core from the center of the core to its outer periphery. A core, whether formed from a single mass, two or more layers, or a liquid center may serve as a center for a wound ball. An intermediate layer may be incorporated, for example, with a single layer or multi-layer cover, with a single mass or multi-layer core, with both a single layer cover and core, or with both a multi-layer cover and a multi-layer core. A layer may additionally be a wound layer composed of a tensioned elastomeric material. Intermediate layers of the type described above are sometimes referred to in the art, and, thus, herein as well, as an inner cover layer, as an outer core layer, or as a mantle layer.

As will be understood by those skilled in the art, polymers such as BR's may be characterized according to various definitions of molecular weight. A common indicator of the degree of molecular weight distribution of a polymer is its polydispersity, defined as the ratio of weight average molecular weight, $M_w$, to number average molecular weight, $M_n$. Polydispersity ("dispersity") also provides an indication of the extent to which the polymer chains share the same degree of polymerization. If the polydispersity is 1.0, then all polymer chains must have the same degree of polymerization. Since $M_w$ is always equal to or greater than $M_n$, polydispersity, by definition, is equal to or greater than 1.0.

In accordance with the present invention, blends of two or more BR components for core compositions comprise predominantly a first BR formed with a cobalt or nickel catalyst (Co/Ni—BR), and to a less extent a second BR formed with a neodymium or lanthanide series catalyst (Nd—BR). To achieve favorable milling and processing characteristics as well as to provide improved resilience, the Co/Ni—BR preferably has a very high Mooney viscosity of from about 50 to about 150, more preferably from about 60 to about 150, and most preferably from about 70 to about 130. The Nd—BR preferably also has a high Mooney viscosity, but lower than that of the Co/Ni—BR, ranging from about 30 to about 100, more preferably from about 35 to about 90, and most preferably from about 45 to about 80. In the present invention, the Mooney viscosity is measured in accordance with "Standard Test Methods for Rubber-Viscosity, Stress Relaxation, and Pre-Vulcanization Characteristics (Mooney Viscometer)" of ASTM D1646-00.

Preferably, both BR's in the blend have high molecular weights, as demonstrated by, among other parameters, a high number average molecular weight $M_n$ and a low polydispersity. Specifically, the Co/Ni—BR has a $M_n$ of from about 150,000 to about 250,000 and a polydispersity of from about 1.50 to about 3.50. The Nd—BR has a $M_n$ of from about 150,000 to about 275,000 and a polydispersity of from about 1.25 to about 2.75. Both BR's of the blend also have a high content of cis-1,4 bonds in the polymer chains. Preferably, the cis-1,4-bond content in each BR is at least about 80%, more preferably at least about 95%.

The golf ball cores of this invention are formed primarily from the BR blends described herein. Preferably, the Co/Ni—BR and the Nd—BR add up to a combined weight percentage of at least about 65% of the total weight of the core. More preferably, the combined weight percentage of the BR blend ranges from about 70% to about 95% of the core. The BR blend is predominantly comprised of the Co/Ni—BR. Preferably the Co/Ni—BR has a weight percentage of at least about 51 parts per hundred ("phr") of the BR blend. The Nd—BR on the other hand has a weight percentage of at least about 5 phr. A ratio of weight percentage between the Co/Ni—BR and the Nd—BR is preferably at least about 51:49, more preferably at least about 60:40, and most preferably at least about 75:25. Unless indicated otherwise, all parts expressed herein are parts by weight.

While any suitable catalysts may be used to synthesize the BR's of this invention, preferably the catalysts include Co, Ni, and Nd catalysts. Examples of the cobalt catalysts include without limitation elemental cobalt and cobalt compounds such as Raney® cobalt; cobalt chloride; cobalt bromide; cobalt iodide; cobalt oxide; cobalt sulfate; cobalt carbonate; cobalt phosphate; cobalt phthalate; cobalt carbonyl; cobalt acetylacetonate; cobalt diethyldithiocarbamate; cobalt anilinium nitrite; cobalt dinitrosyl chloride; and mixtures thereof. Particularly, combinations of these cobalt compounds with a dialkyl aluminum monochloride (e.g., diethyl aluminum monochloride and diisobutyl aluminum monochloride), a trialkyl aluminum (e.g., triethyl aluminum, tri-n-propyl aluminum, triisobutyl aluminum, and tri-n-hexyl aluminum), an alkyl aluminum sesquichloride (e.g., ethyl aluminum sesquichloride), or aluminum chloride are preferred. Polymerization of butadiene in the presence of these catalysts is generally carried out by continuously charging a reactor with butadiene monomer and a catalyst in a solvent such as aliphatic, aromatic and cycloaliphatic hydrocarbon solvents. The reaction temperature is controlled in a range of about 5° C. to about 60° C., and the reaction pressure is in a range from about 1 to about 70 atmospheres such that a product having a predetermined high Mooney viscosity may be obtained.

Nickel catalysts useful for synthesizing Ni—BR include without limitation one-component catalysts such as nickel on diatomaceous earth, two-component catalysts such as Raney® nickel/titanium tetrachloride, and three-component catalysts such as nickel compound/organometal/trifluoroborate etherate. Examples of the nickel compounds used herein include, but are not limited to, reduced nickel on carrier; Raney® nickel; nickel oxides; nickel carboxylate; organic nickel complex salts, and mixtures thereof. Examples of the organometals include, but are not limited to, trialkyl aluminums such as triethyl aluminum, tri-n-propyl aluminum, triisobutyl aluminum, and tri-n-hexyl aluminum; alkyl lithiums such as n-butyl lithium, s-butyl lithium, t-butyl lithium, 1,4-butane dilithium; dialkyl zincs such as diethyl zinc and dibutyl zinc, and mixtures thereof. The process of preparing Ni—BR is similar to that of the Co—BR.

The BR catalyzed with lanthanide series catalysts, according to the present invention, may be prepared by polymerizing butadiene monomer in the presence of catalysts comprising a lanthanide series element and compound, an organoaluminum compound, a Lewis base, and optionally, a Lewis acid. The lanthanide compounds used herein include halides, carboxylates, alcoholates, thioalcoholates, and amides. Preferably the lanthanide element is neodymium. The Lewis bases serve to convert the lanthanide compounds into complexes, and acetylacetone and ketone alcohols and the like may be used for this purpose. In the synthesis of Nd—BR, the Nd catalysts may be used as solution in a suitable solvent such as n-hexane, cyclohexane, n-heptane, toluene, xylene, benzene, etc. or carried on suitable carriers such as silica, magnesia, and magnesium chloride. The polymerization temperature typically ranges from about −30° C. to about 150° C., preferably from about 10° C. to about 80° C. The polymerization pressure may vary depending on other conditions.

Suitable Co—BR's include without limitation Bayer's KA8855; Bayer's Taktene® 220, 221, 1200, 1203G1, 1220 and 8855; and Shell Chemical's Cariflex® 1220, BCP 819, BCP820, BCP 823 and BCP824. Alternatively, Ni—BR's such as Goodyear's Budene® 1207 and 1280 are suitable substitutes. Preferably the Co/Ni—BR is Cariflex® BCP824. Suitable Nd—BR's include without limitation Bayer's Buna® CB10, CB22 and CB23; Enichem's Neocis® BR40 and BR60; Mitsubishi's Ubepol® 130B, 150L and 360L; Shell Chemical's Neodene® 40, 45 and 60; and PetroFlex's PetroFlex® BRNd-40. Preferably the Nd—BR is Buna® CB23.

BR's used in golf ball cores typically incorporate at least one reactive co-agent to enhance their hardness. Suitable co-agent for use in this invention may be formed from an unsaturated carboxylic acid, preferably an α,β-ethylenically unsaturated carboxylic acid having about 3 to 8 carbon atoms, such as methacrylic, acrylic, itaconic, sorbic, cinnamic and crotonic acid. Suitable counterions include, but are not limited to, quaternary phosphonium or ammonium cations such as tetraalkyl phosphonium, and metal cations such as sodium, lithium, potassium, magnesium, calcium, zinc, barium, aluminum, tin, zirconium, nickel and cadmium. Zinc, magnesium and cadmium are preferred as the metal cations.

Other co-agents may comprise unsaturated vinyl compounds including without limitation N,N'-m-phenylene dimaleimide (available as Vanax® MBM from R. T. Vanderbilt); trimethylolpropane trimethacrylate (Sartomer® SR-350 from Sartomer); triallyl trimellitate (Triam® 705 from Wako Chemicals); triallylisocyanurate (Taic® from Nippon Kasei Chemical); acrylate-terminated liquid polybutadiene (PolyBD® 300 from Elf Atochem N.A.); and mixtures thereof. In addition, poly-functional monomers, phenylene bismaleimide and sulfur may also be used as the co-agent.

More preferably, the co-agent is a mono-(meth)acrylic acid or di-(meth)acrylic acid metal salt, wherein the cation is zinc, magnesium, cadmium, or mixtures thereof. As used herein, the term "(meth)acrylic" includes both methacrylic and acrylic. Even more preferably, the co-agent is zinc diacrylate ("ZDA"), zinc dimethacrylate ("ZDMA"), or mixtures thereof. Of the common acrylate cross-linkers, ZDA has generally been found to produce golf balls with greater initial velocity than ZDMA, therefore, the former is most preferred. The ZDA can be of various grades of purity. For the purposes of this invention, the lower the quantity of zinc stearate present in the ZDA the higher the ZDA purity. ZDA containing less than about 10% zinc stearate is preferable. More preferable is ZDA containing between about 4% and about 8% zinc stearate. Suitable, commercial sources for ZDA include Sartomer and Nippon-Zeon Corporation. The co-agent may be present in an amount from about 0 to about 50 phr by weight of the BR blend.

It has been determined that BR blends having little or no reactive co-agents such as ZDA concomitantly have low water vapor transmission rates ("WVTR"). Such BR blends may be preferred in forming golf ball cores because they are less prone to moisture absorption and related deterioration in playability and performance by virtue of the low permeability. This in turn extends golf balls' shelf life and enhances their resistance to weathering. Therefore, the BR blend preferably has a low co-agent composition comprising a co-agent such as ZDA in an amount less than about 10 phr by weight of the BR blend, and a WVTR less than about 250 g·mil/100 $in^2$·24 h. More preferably, the amount of the co-agent is less than about 5 phr, and the WVTR is less than about 170 g·mil/100 $in^2$·24 h. Most preferably, the amount of the co-agent in the BR blend of the core is about 0 phr.

Conventionally, a free radical initiator is used to promote the crosslink reaction between the reactive co-agent and the BR. The free radical initiators included in the core compositions herein may be any known polymerization initiators that decompose during the curing cycle. Suitable initiators include peroxides, persulfates, azo compounds and hydrazides. Examples of the peroxides for the purposes of the present invention include dicumyl peroxide; n-butyl-4,4-di(t-butylperoxy)-valerate; 1,1-bis(t-butylperoxy)-3,3,5-trimethylcyclohexane; αα'-bis(t-butylperoxy)-diisopropylbenzene; 2,5-dimethyl-2,5-di(t-butylperoxy) hexane; di-t-butyl peroxide; di-t-amyl peroxide; di(2-t-butyl-peroxyisopropyl)benzene peroxide; lauryl peroxide; benzoyl peroxide; t-butyl hydroperoxide; and mixtures thereof. Preferably, the peroxide initiator is dicumyl peroxide having an activity between about 40% and about 100%. Also preferably, the initiator is present in the BR blend in an amount ranging between about 0.05 phr and about 15 phr by weight of the BR blend. More preferably, the amount of the initiator ranges between about 0.1 phr and about 5 phr, and most preferably between about 0.25 and about 1.5 phr. It will be understood that the total amount of initiators used will vary depending on the specific end product desired and the particular initiators employed.

Alternatively, sulfur-based curing agents with optional accelerators may be use in combination with or in replacement of the peroxide initiators to crosslink the BR, as described in U.S. patent application Ser. No. 09/894,960, the disclosure of which is incorporated herein by reference in its entirety. Other useful initiators would be readily apparent to one of ordinary skill in the art. The initiator may alternatively or additionally be one or more of electron beams; gamma radiation; infrared radiation; ultra-violet radiation; X-ray radiation; or any other high-energy radiation source capable of generating free radicals. It should be further understood that heat often facilitates initiation of the generation of free radicals.

One or more other optional BR or elastomeric components may also be blended with the two BR components described herein to formulate the core compositions with various properties. Suitable natural or synthetic elastomers include any of the Co/Ni—BR and Nd—BR listed above, as well as polybutadiene rubber; natural rubber; balata; gutta-percha; synthetic polyisoprene; <styrene-butadiene rubber; styrene-propylene-diene rubber; chloroprene rubber; acrylonitrile rubber; acrylonitrile-butadiene rubber; ethylene-propylene rubber; ethylene-propylene-diene terpolymer ("EPDM"); and mixtures thereof.

The core compositions of the present invention may additionally comprise any other suitable and compatible modifying ingredients including, but not limited to, metal oxides, fatty acids, and diisocyanates. For example, metal oxides such as zinc oxide and/or magnesium oxide may be added as activators for the BR. Fatty acids or metallic salts of fatty acids such as stearic, palmitic, oleic and linoleic acids may be included as moldability and processing additives. Polymeric diisocyanates such as 4,4'-diphenylmethane diisocyanate and other polyfunctional isocyanates may also be incorporated in the rubber compositions as moisture scavengers. Other additives suitable for the core compositions, including stable free radicals; free radical scavangers; scorch retarders; cis-to-trans catalysts; density fillers; nanofillers; dispersing agents; foaming agents; antioxidants; chain-transfer agents; stabilizers; processing aids; processing oils; plasticizers; dyes and pigments; as well as other additives well known to the skilled artisan, may also be used in the present invention in amounts sufficient to achieve the purpose for which they are typically used.

The compositions disclosed herein in the present invention may be utilized independently or in combination to form any portions of a golf ball of any constructions. The golf ball may be one-piece, two-piece, three-piece, multi-layered, or wound. The golf ball may have a center that is solid, hollow, gas-filled, gel-filled or fluid-filled. Suitable filling materials for golf ball cores include gas, water or water solutions, gels, foams, hot-melts, other fluid materials and combinations thereof, as described in U.S. Pat. No. 6,287,216, the disclosure of which is incorporated herein by reference in its entirety. The golf ball may comprise one or more layers around the center including without limitation inner core layers; outer core layers; wound layers; intermediate layers; inner cover layers; outer cover layers; coating layers; and combinations thereof. Any of these layers may comprise the BR blend compositions described herein. Without limitation, certain embodiments of the present invention are illustrated below.

In one embodiment, a golf ball comprises a cover and a solid or multi-layered solid core comprising a BR blend of the present invention. The core may further comprise a low co-agent composition described herein. The multi-layered solid core may comprise a solid center and at least one intermediate layer such as an outer core layer. Preferably the entire core has an outer diameter of less than about 1.65 inches, more preferably about 1.00 inch to about 1.65 inches, and most preferably about 1.40 inches and about 1.65 inches. The cover typically has a thickness between about 0.01 inches and about 0.20 inches to provide sufficient strength, good performance characteristics, and durability. Other properties that are desirable for the cover include good moldability, high abrasion resistance, high tear strength, high resilience, and good mold release. The cover may have a single layer, or optionally comprise at least one inner cover layer and one outer cover layer.

In another embodiment of the invention, a golf ball comprises a core, a cover, and at least one intermediate layer disposed between the core and the cover, wherein the intermediate layer has an elastomeric composition with a low level of co-agent and a low WVTR as described herein. The intermediate layer acts as a water vapor barrier to either block out undesirable moisture in golf ball constructions where the core is solid, or seal in the desirable moisture or gas in golf ball constructions where the core is hollow, gas-filled, gel-filled or fluid-filled. Intermediate layer having the low co-agent composition tends to be quite soft. Preferably the intermediate layer has a hardness of less than about 70 Shore C, more preferably less than about 65 Shore C, and most preferably less than about 60 Shore C. Preferably, the core has an outer diameter of about 0.25 inches to about 1.60 inches. The intermediate layer preferably has an outer diameter between about 0.78 inches and about 1.65 inches, and a thickness between about 0.01 inches and about 0.60 inches, more preferably between about 0.01 inches and about 0.40 inches, and most preferably between about 0.02 inches and about 0.10 inches. The core, the intermediate layer, or both may comprise a BR blend of the present invention.

In yet another embodiment, a golf ball comprises a core, a cover, and at least one intermediate layer disposed between the core and the cover, wherein the intermediate layer comprises a BR blend of at least one Co/Ni—BR of the invention and at least one Nd—BR of the invention. The Co/Ni—BR may have a Mooney viscosity less than or equal to that of the Nd—BR, preferably it is greater than that of the Nd—BR. The BR blend comprises at least about 40% by weight of the intermediate layer, preferably it comprises at least about 65%. Weight distribution between the Co/Ni—BR and the Nd—BR within the intermediate layer is not limited. That is, a ratio between the weight percentages of the Co/Ni—BR and the Nd—BR may range from about 5:95 to about 95:5. Preferably, this weight percentage ratio is at least about 50:50, so that the Co/Ni—BR is present in an amount greater than or equal to that of the Nd—BR. The core may comprise an elastomeric composition such as the BR blends of the invention, having a high weight percentage of co-agents such as ZDA. Preferably, the co-agent level in the core is at least about 15 phr by weight of the elastomer, more preferably at least about 30 phr, and most preferably at least about 50 phr. The high level of co-agent in the core and the low level of co-agent in the intermediate layer result in a hard core surrounded with a soft intermediate layer, providing the golf ball with desirable properties such as increased resilience. The intermediate layer may be an outer core layer or an inner cover layer. The core may comprise a center and at least one outer core layer, while the cover may comprise at least one inner cover layer and an outer cover layer.

In a further embodiment, a golf ball comprises a core, a cover, and at least one intermediate layer disposed between the core and the cover, wherein the intermediate layer has an elastomeric composition having a high weight percentage of co-agents such as ZDA. Preferably the weight percentage of co-agent in the intermediate layer is at least about 15 phr by weight of the elastomer, more preferably at least about 30 phr, and most preferably at least about 50 phr. The intermediate layer preferably has a hardness of greater than about 80 Shore C. A core assembly comprising the intermediate layer preferably has an Atti compression of at least about 30, more preferably between about 40 and about 80, most preferably between about 50 and about 70. The intermediate layer may further comprise density fillers such as metal oxides to increase its specific gravity to be preferably greater than about 1.0, more preferably greater than about 1.2. Preferably, the intermediate layer is a thin dense layer having a thickness of between about 0.010 inches and about 0.100 inches, and more preferably, between about 0.020 inches and about 0.080 inches. The core, on the other hand, preferably has a low co-agent composition described herein. The core has an outer diameter preferably less than about 1.60 inches, and more preferably between about 1.40 inches and about 1.58 inches. Such a construction results in a golf ball subassembly having a soft and lightweight core surrounded with a hard and weighted intermediate layer. Golf balls formed with such subassemblies are therefore perimeter weighted and tend to have desirable high COR and high moment of inertia.

The elastomers suitable for the embodiments of the present invention include without limitation any natural or synthetic diene rubbers such as natural rubber; balata; gutta-percha; cis-polybutadiene; trans-polybutadiene; synthetic polyisoprene; polyoctenamer; and mixtures thereof. Preferably the elastomer is polybutadiene. Metallocene rubbers are also preferred for the elastomeric compositions, including without limitation polybutadiene; ethylene-propylene; EPDM; styrene-butadiene rubber; styrene-propylene-diene rubber; and mixtures thereof. These metallocene rubbers are typically synthesized via the co-polymerization of functionalized monomers using metallocene catalysts or other single-site catalysts. The elastomeric composition may also comprise chloroprene rubber; acrylonitrile rubber; acrylonitrile-butadiene rubber; styrene-ethylene block copolymer; maleic anhydride or succinate modified metallocene catalyzed ethylene copolymer; polypropylene resin; ionomer resin; polyamide; polyester; urethane; polyurea; chlorinated polyethylene; polysulfide rubber; flurocarbon; and mixtures thereof. A exemplary formulation for the elastomeric composition includes about 100 parts of a cis- or trans-polybutadiene, about 5 parts of zinc oxide, between about 0.5 parts to about 5 parts of dicumyl peroxide, with optionally about 1 part to about 25 parts of zinc stearate. A second examplary formulation for the elastomeric composition comprises about 100 parts of a metallocene catalyzed EPDM, about 5 parts of zinc oxide, about 1 part of zinc stearate, about 2 parts of zinc dithiobutyldithiocarbamate, about 0.5 parts of tetramethylthiuram, and about 1.5 parts of sulfur. The metallocene catalyzed EPDM preferably has a high ethylene content between about 70% to about 90% by weight of the EPDM, between about 1% and about 5% of ethylidene-2-norborene, a Mooney viscosity between about 20 and about 40, and a density between about 0.87 g/cc and about 0.93 g/cc.

The materials used in forming either a golf ball core or any portion of a multi-layered golf ball, in accordance with the invention, may be combined to form a mixture by any type of mixing known to one of ordinary skill in the art. Suitable types of mixing include single pass and multi-pass mixing. Suitable mixing equipment is well known to those of ordinary skill in the art, and such equipment may include a Banbury mixer, a two-roll mill, or a twin screw extruder. Conventional mixing speeds for combining polymers are typically used. The mixing temperature depends upon the type of polymer components, and more importantly, on the type of free-radical initiator. Suitable mixing speeds and temperatures are well known to those of ordinary skill in the art, or may be readily determined without undue experimentation.

The mixture can be subjected to a compression or injection molding process to obtain solid spheres for the center or hemispherical shells for forming an intermediate layer. The temperature and duration of the molding cycle are selected based upon reactivity of the mixture. The molding cycle may have a single step of molding the mixture at a single temperature for a fixed duration of time. The molding cycle may also include a two-step process, in which the polymer mixture is held in the mold at an initial temperature for an initial duration of time, followed by holding at a second, typically higher temperature for a second duration of time. Preferably a single-step cure cycle is employed. Although the curing time depends on the various materials selected, those of ordinary skill in the art will be readily able to adjust the curing time upward or downward based on the particular materials used and the discussion herein.

The golf ball cover is preferably tough, cut-resistant, and selected from conventional materials used as golf ball covers based on the desired performance characteristics. The cover may comprise one or more layers. When a golf ball of the present invention includes at least one inner cover layer and an outer cover layer, these layers may comprise thermoplastic and/or thermosetting materials such as ionic copolymers or terpolymers of ethylene and an unsaturated monocarboxylic acid, including Surlyn® and Ioteck®. The carboxylic acid groups in these ionomers include methacrylic, crotonic, maleic, fumaric or itaconic acid totally or partially neutralized with metal salts.

Materials suitable for homopolymeric or copolymeric inner and/or outer covers further include, without limitation, vinyl resins comprising vinyl chloride; polyolefins such as polyethylene and ethylene methylacrylate copolymer; polyurethanes comprising polyols and polyisocyanates; polyureas; polyamides such as poly(hexamethylene adipamide) and poly(caprolactam); acrylic resins and blends thereof; block copolymers such as styrene-butadiene rubber and isoprene- or ethylene-butylene rubber; copoly(ether-amide) such as Pebax®; polyphenylene oxide resins and blends thereof such as Noryl®; thermoplastic polyesters such as Hytrel® and Lomod®; blends and alloys including polycarbonate with acrylonitrile butadiene styrene and polyvinyl chloride with acrylonitrile butadiene styrene; blends of thermoplastic rubbers with polyethylene and propylene; and mixtures thereof. Conventional additives suitable for the cover layer compositions of the present invention include, but are not limited to, antioxidants; catalysts; colorants including pigments and dyes; hindered amine light stabilizers; optical brighteners; UV absorbers; metals; plasticizers; surfactants; viscosity modifiers; compatibility agents; dispersing agents; foaming agents; reinforcement agents; release agents; and mixtures thereof. Such additives may be incorporated in any amounts that will achieve their desired purpose.

Any method known to one of ordinary skill in the art may be used to prepare polyurethane cover layers of the present invention, including one-shot method and prepolymer method. Other methods suitable for forming the cover layers of the present invention include reaction injection molding ("RIM"), liquid injection molding ("LIM"), and pre-reacting the components to form an injection moldable thermoplastic polyurethane and then injection molding, all of which are known to one of ordinary skill in the art. Castable, reactive liquids that react to form a urethane elastomer material can be applied over the core to form desirable very thin outer cover layers using a variety of application techniques such as spraying, dipping, spin coating, or flow coating methods.

When golf balls are prepared according to the invention, they typically will have dimple coverage greater than about 60 percent, preferably greater than about 65 percent, and more preferably greater than about 75 percent. The resultant golf balls typically have a coefficient of restitution of greater than about 0.700, preferably greater than about 0.780, and more preferably greater than about 0.800. The golf balls also typically have an Atti compression of at least about 40, preferably from about 50 to about 120, and more preferably from about 60 to about 105. The flexural modulus of the cover on the golf balls, as measured by ASTM method D6272-98, Procedure B, is typically greater than about 500 psi, and is preferably from about 5,000 psi to about 15,000 psi. Alternatively, the cover may have a flexural modulus between about 20,000 psi and about 400,000 psi. As discussed herein, the outer cover layer is preferably formed from a relatively soft polyurethane material. In particular, the material of the outer cover layer should have a material hardness, as measured by ASTM-D2240, preferably less than about 60 Shore D, more preferably less than about 50 Shore D, and most preferably between about 30 and about 50 Shore D. The inner cover layer preferably has a material hardness of less than about 80 Shore D, more preferably between about 30 and about 75 Shore D, and most preferably between about 50 and about 70 Shore D.

It should be understood, especially to one of ordinary skill in the art, that there is a fundamental difference between "material hardness" and "hardness, as measured directly on a golf ball." Material hardness is defined by the procedure set forth in ASTM-D2240 and generally involves measuring the hardness of a flat "slab" or "button" formed of the material of which the hardness is to be measured. Hardness, when measured directly on a golf ball (or other spherical surface) is a completely different measurement and, therefore, results in a different hardness value. This difference results from a number of factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other.

All patents and patent applications cited in the foregoing text are expressly incorporated herein by reference in their entirety.

The term "about," as used herein in connection with one or more numbers or numerical ranges, should be understood to refer to all such numbers, including all numbers in a range.

The invention described and claimed herein is not to be limited in scope by the specific embodiments herein disclosed, since these embodiments are intended solely as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. For example, the BR blends of the invention, in combination with the various low, medium and high levels of the reactive co-agent, may be present in a form of regrinds. Such regrinds may subsequently be incorporated into various portions of the golf balls, including the core, the intermediate layers, and the cover.

What is claimed is:

1. A golf ball comprising a core, a cover, and at least one intermediate layer disposed between the core and the cover, wherein the intermediate layer comprises an elastomeric composition formed from a reactive co-agent in an amount of about 10 phr or less by weight of the elastomer and a polybutadiene blend comprising:

a first polybutadiene formed with a cobalt or nickel catalyst having a first Mooney viscosity of from about 50 to about 150, and a second polybutadiene formed with a neodymium catalyst having a second Mooney viscosity of from about 30 to about 100.

2. The golf ball of claim 1, wherein the intermediate layer has a water vapor transmission rate of less than about 250 g·mil/100 $in^2$·24 h.

3. The golf ball of claim 1, wherein the reactive co-agent comprises a salt of an unsaturated carboxylic acid having about 3 to 8 carbon atoms; an unsaturated vinyl compound; polyfunctional monomer; phenylene bismaleimide; or a mixture thereof.

4. The golf ball of claim 1, wherein the core is solid, hollow, gas-filled, gel-filled, or fluid-filled.

5. The golf ball of claim 1, wherein the core comprises an elastomeric composition having a reactive co-agent in an amount between about 10 phr and about 50 phr by weight of the elastomer.

6. The golf ball of claim 1, wherein the core comprises an elastomeric composition having a reactive co-agent in an amount of at least about 50 phr by weight of the elastomer.

7. The golf ball of claim 1, wherein the core has an outer diameter of about 0.25 inches to about 1.60 inches.

8. The golf ball of claim 1, wherein the intermediate layer has a thickness between about 0.01 inches and about 0.60 inches.

9. The golf ball of claim 8, wherein the thickness of the intermediate layer is between about 0.02 inches and about 0.10 inches.

10. The golf ball of claim 1, wherein the intermediate layer comprises two or more layers.

11. The golf ball of claim 1, wherein the cover comprises two or more layers.

12. The golf ball of claim 1, wherein the core comprises a center and at least one outer core layer.

13. The golf ball of claim 1, wherein the elastomeric composition further comprises one or more materials selected from the group consisting of natural rubber; balata; gutta-percha; cis-polybutadiene; trans-polybutadiene; synthetic polyisoprene; polyoctenamer, styrene-propylene-diene rubber; metallocene rubber; styrene-butadiene rubber; ethylene-propylene rubber; chloroprene rubber; acrylonitrile rubber; acrylonitrile-butadiene rubber; styrene-ethylene block copolymer, ethylene-propylene-diene terpolymer; maleic anhydride or succinate modified metallocene catalyzed ethylene copolymer; polypropylene resin; ionomer resin; polyamide; polyester; urethane; polyurea; chlorinated polyethylene; polysulfide rubber; and fluorocarbon.

* * * * *